US010570899B2

(12) United States Patent
Lee et al.

(10) Patent No.: US 10,570,899 B2
(45) Date of Patent: Feb. 25, 2020

(54) SCROLL COMPRESSOR HAVING SCROLL WITH OIL DIMPLES

(71) Applicant: LG ELECTRONICS INC., Seoul (KR)

(72) Inventors: Kangwook Lee, Seoul (KR); Yongkyu Choi, Seoul (KR); Cheolhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 303 days.

(21) Appl. No.: 15/491,059

(22) Filed: Apr. 19, 2017

(65) Prior Publication Data

US 2017/0306963 A1 Oct. 26, 2017

(30) Foreign Application Priority Data

Apr. 26, 2016 (KR) ..... 10-2016-0051054

(51) Int. Cl.
*F03C 2/00* (2006.01)
*F03C 4/00* (2006.01)
(Continued)

(52) U.S. Cl.
CPC ..... *F04C 29/0071* (2013.01); *F04C 18/0215* (2013.01); *F04C 18/0253* (2013.01);
(Continued)

(58) Field of Classification Search
CPC ..... F04C 18/0215; F04C 18/0253; F04C 18/0261; F04C 18/0269; F04C 23/008;
(Continued)

(56) References Cited

U.S. PATENT DOCUMENTS

2011/0243777 A1 10/2011 Ito et al.
2016/0040673 A1 2/2016 Lee et al.
2016/0108917 A1 4/2016 Bonnefoi et al.

FOREIGN PATENT DOCUMENTS

CN 101287910 10/2008
CN 105370570 3/2016
(Continued)

OTHER PUBLICATIONS

JP07286586A—Kosho et al.—Scroll Type Fluid Device—Oct. 31, 1995—English Translation—(Year: 1995).*
(Continued)

*Primary Examiner* — Theresa Trieu
(74) *Attorney, Agent, or Firm* — Ked & Associates LLP

(57) ABSTRACT

A scroll compressor may include a casing configured to contain oil at a lower portion; a drive motor provided in the casing; a rotational shaft coupled to the drive motor, and having an oil supply passage in order to guide oil contained in the casing to an upper side; a frame provided below the drive motor; a fixed scroll provided below the frame, and having a fixed wrap; and an orbiting scroll provided between the frame and the fixed scroll, having an orbiting wrap to form a compression chamber with the fixed wrap, and having rotational shaft coupling portion. One or more oil dimples may be formed at a peripheral end surface of the rotational shaft coupling portion. With such a configuration, as oil may be smoothly supplied to an end surface of the orbiting wrap near the rotational shaft coupling portion, abrasion may be prevented.

16 Claims, 16 Drawing Sheets

(51) Int. Cl.

| | |
|---|---|
| ***F04C 2/00*** | (2006.01) |
| ***F04C 18/00*** | (2006.01) |
| ***F04C 29/00*** | (2006.01) |
| ***F04C 18/02*** | (2006.01) |
| ***F04C 29/02*** | (2006.01) |
| *F04C 23/00* | (2006.01) |

(52) U.S. Cl.
CPC ..... *F04C 18/0261* (2013.01); *F04C 18/0269* (2013.01); *F04C 29/0085* (2013.01); *F04C 29/023* (2013.01); *F04C 23/008* (2013.01); *F04C 2240/30* (2013.01); *F04C 2240/603* (2013.01); *F04C 2240/809* (2013.01)

(58) Field of Classification Search
CPC .. F04C 29/0071; F04C 29/0085; F04C 29/02; F04C 29/023; F04C 29/025; F04C 2240/30; F04C 2240/60; F04C 2240/603; F04C 2240/809
USPC ..... 418/55.1–55.6, 57, 88, 94, 97–99, 270; 184/6.16, 6.17
See application file for complete search history.

(56) References Cited

FOREIGN PATENT DOCUMENTS

| | | |
|---|---|---|
| CN | 105370571 | 3/2016 |
| EP | 2 369 182 | 9/2011 |
| JP | 7-286586 | 10/1995 |
| JP | 2001-304149 | 10/2001 |
| JP | 2007-051558 | 3/2007 |
| KR | 10-2004-0014603 | 2/2004 |
| KR | 10-2008-0109942 | 12/2008 |
| KR | 10-1059880 | 8/2011 |
| KR | 10-2013-0094124 | 8/2013 |
| KR | 10-2016-0022146 | 2/2016 |
| WO | WO 2012/029203 | 3/2012 |
| WO | WO 2013/145017 | 10/2013 |

OTHER PUBLICATIONS

Chinese Office Action dated Jul. 4, 2018 issued in Application No. 201710281491.5.
European Search Report dated Oct. 18, 2017 issued in Application No. 17166250.5.
International Search Report dated Jun. 7, 2017.

* cited by examiner

SCROLL COMPRESSOR HAVING SCROLL WITH OIL DIMPLES

CROSS-REFERENCE TO RELATED APPLICATION(S)

Pursuant to 35 U.S.C. § 119(a), this application claims the benefit of an earlier filing date of and the right of priority to Korean Application No. 10-2016-0051054, filed in Korea on Apr. 26, 2016, the contents of which are incorporated by reference herein in its entirety.

BACKGROUND

1. Field

A scroll compressor is disclosed herein.

2. Background

Generally, a scroll compressor is being widely used in air conditioners, for example, in order to compress a refrigerant, owing to its advantages that a compression ratio is relatively higher than that of other types of compressors, and a stable torque is obtainable as processes for suction, compressing, and discharging a refrigerant are smoothly performed. A behavior characteristic of the scroll compressor is determined by a non-orbiting wrap (hereinafter, referred to as a "fixed wrap") of a non-orbiting scroll (hereinafter, referred to as a "fixed scroll") and an orbiting wrap of an orbiting scroll. The fixed wrap and the orbiting wrap may have any shape, but they generally have a shape of an involute curve for easy processing. The involute curve means a curved line corresponding to a moving path drawn by the end of a thread when the thread wound around a basic circle having any radius is unwound. In a case of using such an involute curve, a capacity change rate is constant as a wrap thickness is constant. Therefore, in order to obtain a sufficient compression ratio, a number of turns of the wrap should be increased. However, this may increase a size of the scroll compressor.

Generally, the orbiting scroll is provided with a plate of a disc shape, and the aforementioned orbiting wrap is formed at one side surface of the plate. At another side surface of the plate where the orbiting wrap is not formed, a boss portion having a predetermined height is formed. A rotational shaft is coupled to the boss portion in an eccentric manner, thereby making the orbiting scroll perform an orbiting movement. As the orbiting wrap may be formed on an entire area of the plate, a diameter of the plate for the same compression ratio may be reduced. However, as the orbiting wrap and the boss portion are spaced from each other in an axial direction, an action point at which a repulsive force of a refrigerant is applied during a compression process, and an action point at, which a reaction for attenuation of the repulsive force is applied, are spaced from each other in the axial direction. This may cause the orbiting scroll to be inclined as the repulsive force and the reaction are operated as a couple (of force) when the scroll compressor is driven. As a result, vibration or noise may be increased.

In order to solve such a problem, there has been disclosed a scroll compressor in Korean Patent Registration No. 10-1059880, which is hereby incorporated by reference, for which a coupling point between a rotational shaft and an orbiting scroll is formed on a same plane as an orbiting wrap. In the scroll compressor, an action point at which a repulsive force of a refrigerant is applied, and an action point at which a reaction for attenuation of the repulsive force is applied, are operated at a same height in opposite directions. This y solve a problem that the orbiting scroll is inclined.

The scroll compressor for which an eccentric portion of the rotational shaft is coupled to the orbiting wrap of the orbiting scroll it an overlapped manner may include not only an upper compression type scroll compressor for which a compression part or device is positioned above a motor part or motor, but also a lower compression type scroll compressor for which a compression part or device is positioned below a motor part or motor. In the upper compression type scroll compressor and the lower compression type scroll compressor, as a rotational shaft is inserted into the orbiting scroll up to a height where it is overlapped with an orbiting wrap of an orbiting scroll, an orbiting wrap forming space in a condition of a same-sized plate is reduced. Therefore, in order to increase a compression ratio in a condition of the same-sized plate, a bearing area, should be minimized at a region at which the rotational shaft and the orbiting scroll are coupled to each other, and a high bearing performance should be obtained. In order to enhance a bearing performance at the region at which the rotational shaft and the orbiting scroll are coupled to each other, oil should be smoothly supplied.

In a case of the upper compression type scroll compressor, as a distance between an oil storage space and a compression part or device is long, oil supply is difficult. Further, a difference in an oil supply amount becomes large according to a drive speed of the scroll compressor. On the other hand, in a case of the lower compression type scroll compressor, as a distance between an oil storage space and a compression part or device is short, oil supply is performed relatively uniformly. However, as a compressed refrigerant blocks an oil supply passage, oil supply is difficult structurally.

Further, the upper compression type scroll compressor and the lower compression type scroll compressor may have a lowered reliability in a condition of a high temperature and a high compression ratio, as there is a region having a large friction area at a central part or portion of the orbiting scroll. That is, in the scroll compressor, while the orbiting scroll performs an orbiting movement in a state in which an end surface of an orbiting wrap contacts a plate surface of a fixed scroll, oil on the plate surface is transferred to the end surface of the orbiting wrap for lubrication. Therefore, a width of the end surface of the orbiting wrap (a wrap thickness in a direction perpendicular to a wrap moving direction) should be smaller than an orbiting radius, for lubrication of the wrap end surface (wrap tip surface).

However, in a structure where the eccentric portion of the rotational shaft is coupled to the orbiting scroll in a penetrating manner, a peripheral end surface of a rotational shaft coupling portion to couple the rotational shaft thereto has a region larger than an orbiting radius. As oil is not smoothly introduced into the region, the end surface of the rotational shaft coupling portion, or the plate surface of the fixed scroll corresponding thereto may partially have abrasion. Especially, when the orbiting scroll is formed of a softer material than the fixed scroll, the peripheral end surface of the rotational shaft coupling portion is severely abraded. As a result, a gap may occur between the orbiting scroll and the fixed scroll, and a compressed refrigerant may leak through the gap. This may lower a reliability due to refrigerant leakage when the scroll compressor is driven with a high compression ratio.

BRIEF DESCRIPTION OF THE DRAWINGS

Embodiments will be described in detail with reference to the following drawings in which like reference numerals refer to like elements, and wherein:

FIG. 9A-9D illustrate various embodiments with respect to a shape of an oil dimple in the scroll compressor of FIG. 1, in which FIG. 9A is a planar view illustrating an oil dimple formed only at an end surface of a rotational shaft coupling portion;

FIGS. 9B and 9C are planar views illustrating one oil dimple;

FIG. 9D is a planar view illustrating two oil dimples;

DETAILED DESCRIPTION

Figure 1:
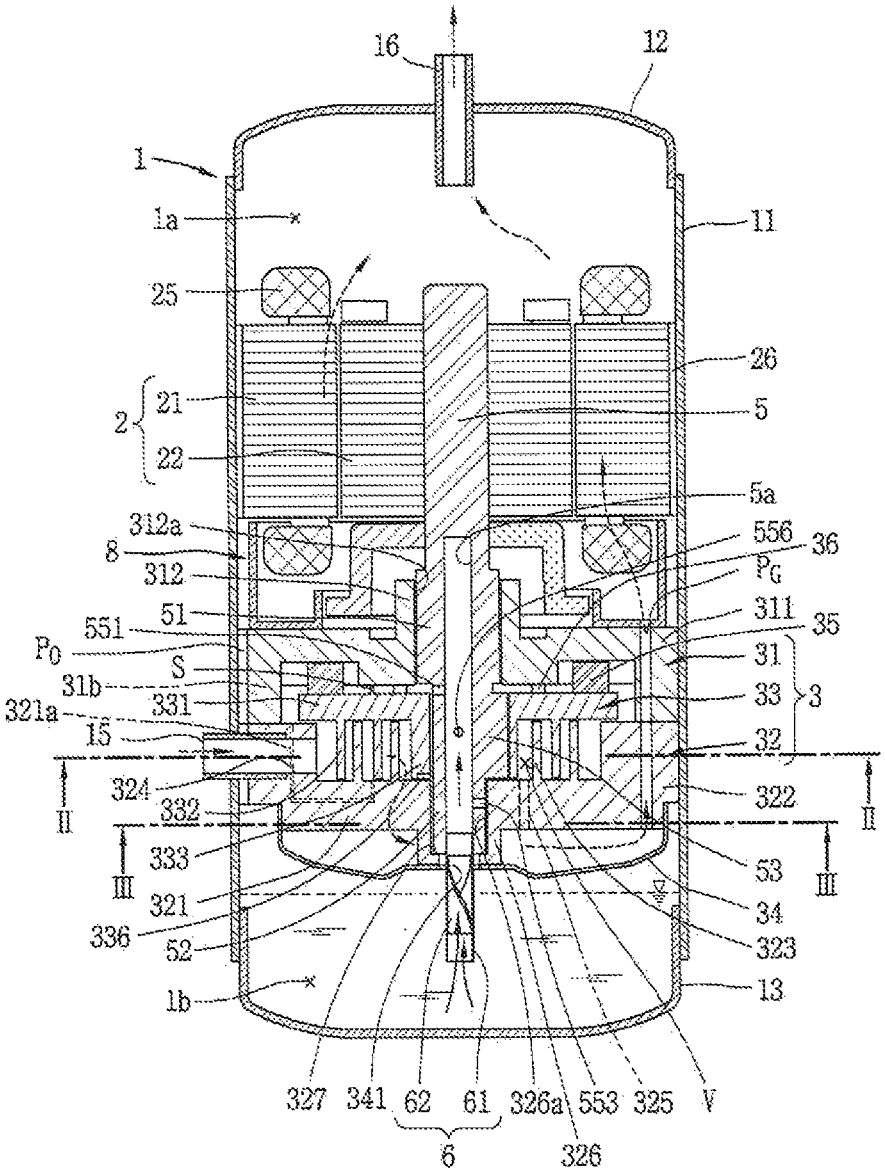
FIG. 1 is a longitudinal sectional view illustrating an example of a lower compression type scroll compressor according to an embodiment.

Hereinafter, a scroll compressor according to embodiments will be explained with reference to the attached drawings. Where possible, like reference numerals have been used to indicate like elements, and repetitive disclosure has been omitted.

Figure 2:
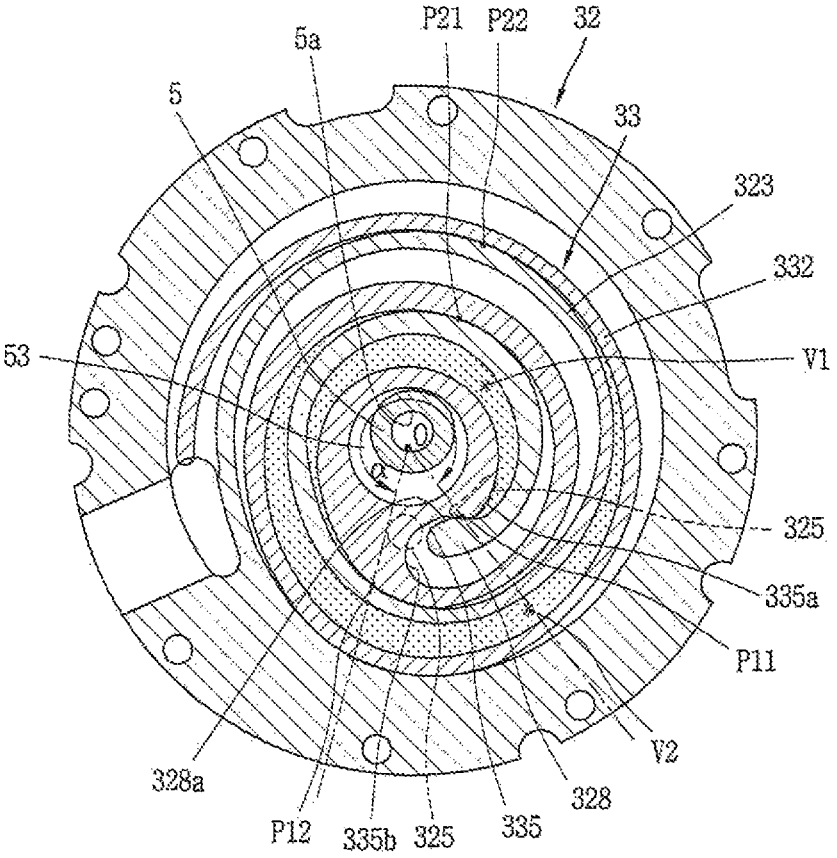
FIG. 2 is a sectional view taken along line 'II-II' in FIG. 1.
Figure 3:
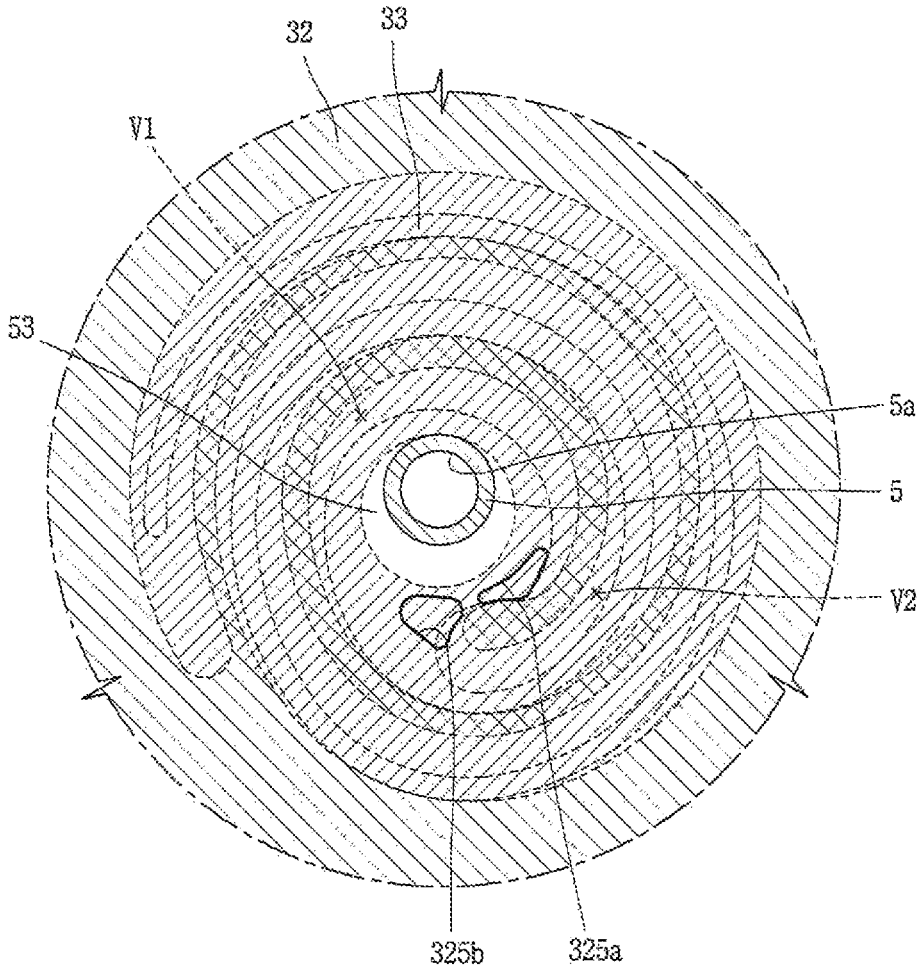
FIG. 3 is a sectional view taken along line 'III-III' in FIG. 1.
Figure 4:
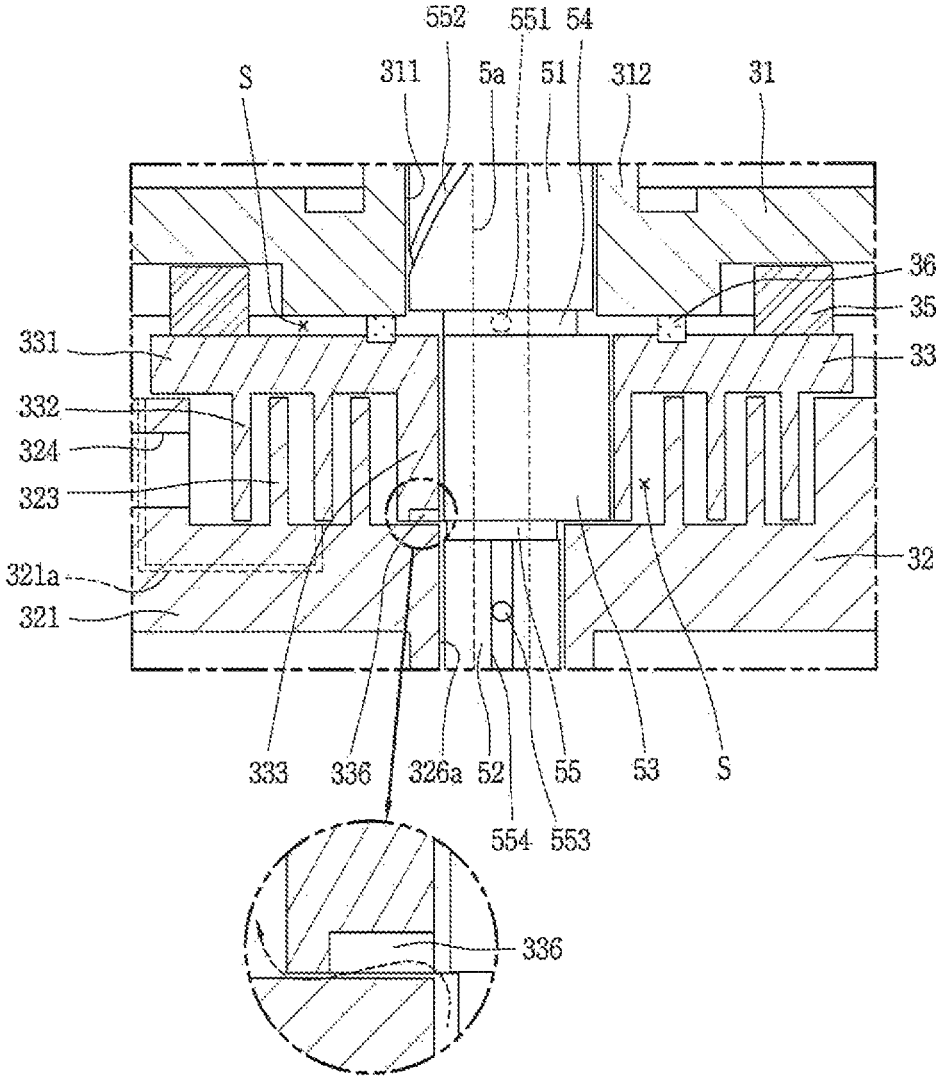
FIG. 4 is a longitudinal sectional view which illustrates a compression part or, device in the scroll compressor of FIG. 1, in an enlarged manner.

FIG. 1 is a longitudinal sectional view illustrating an example of a lower compression type scroll compressor according to an embodiment. FIG. 2 is a sectional view taken along line 'II-II' in FIG. 1. FIG. 3 is a sectional view taken along line 'III-III' in FIG. 1. And FIG. 4 is a longitudinal sectional view which illustrates a compression part or device in the scroll compressor of FIG. 1, in an enlarged manner.

As shown, the lower compression type scroll compressor according to this embodiment may include a casing 1 having an inner space 1*a*; a motor part or motor 2 provided at the inner space 1*a* of the casing 1, and configured to generate a rotational force in the form of a drive motor; a compression part or device 3 disposed or provided below the motor part 2, and configured to compress a refrigerant by receiving the rotational force of the motor part 2. The casing 1 may include a cylindrical shell 11 which forms a hermetic container; an upper shell 12 which forms the hermetic container together by covering an upper part or portion of the cylindrical shell 11; and a lower shell 13 which forms the hermetic container together by covering a lower part or portion of the cylindrical shell 11, and which forms an oil storage space 1*b*.

A refrigerant suction pipe 15 may be penetratingly-formed at a side surface of the cylindrical shell 1 thereby directly communicating with a suction chamber of the compression part 3. A refrigerant discharge pipe 16 that communicates with the inner space 1*a* of the casing 1 may be installed or provided at an upper part or portion of the upper shell 12. The refrigerant discharge pipe 16 may be a passage along which a refrigerant compressed by the compressor part 3 and discharged to the inner space 1*a* of the casing 1 may be discharged to the outside. An oil separator (not shown) that separates oil mixed with the discharged refrigerant may be connected to the refrigerant discharge pipe 16.

A stator 21 which constitutes or forms the motor part 2 may be installed or provided at an upper part or portion of the casing 1, and a rotor 22 which constitutes or forms the motor part 2 together with the stator 21 and rotated by a reciprocal operation with the stator 21 may be rotatably installed or provided in the stator 21. A plurality of slots (not shown) may be formed on an inner circumferential surface of the stator 21 in a circumferential direction, on which a coil 25 may be wound. An oil collection passage 26 configured to pass oil therethrough may be formed between an outer circumferential surface of the stator 21 and an inner circumferential surface of the cylindrical shell 11 in a D-cut, shape.

A main frame 31 which constitutes or forms the compression part 3 may be fixed to an inner circumferential surface of the casing 1, below the stator 21 with a predetermined gap therebetween. The main frame 31 may be coupled to the cylindrical shell 11 as an outer circumferential surface of the main frame 31 is welded or shrink-fit to an inner circumferential surface of the cylindrical shell 11.

A ring-shaped frame side wall portion or side wall (first side wall portion or side wall) 311 may be formed at an edge of the main frame 31 and a first shaft accommodating portion 312 configured to support a main bearing portion 51 of a rotational shaft 5, which is discussed hereinafter, may be formed at a central part or portion of the main frame 31. A first shaft accommodating hole 312*a*, configured to rotatably insert the main bearing portion 51 of the rotational shaft 5 and support the main bearing portion 51 in a radial direction, may be penetratingly-formed at the first shaft accommodating portion 312 in an axial direction.

A fixed scroll 32 may be installed or provided at a bottom surface of the main frame 31, in a state in which an orbiting scroll 33 eccentrically-coupled to the rotational shaft 5 is disposed between the fixed scroll 32 and the main frame 31. The fixed scroll 32 may be fixedly-coupled to the main frame 31, and may be fixed to the main frame 31 so as to be moveable in the axial direction.

The fixed scroll 32 may include a fixed plate portion or plate (hereinafter, referred to as a "first plate portion" or first "plate") 321 formed in an approximate disc shape, and a scroll side wall portion or side wall (hereinafter, referred to as a "second side wall portion" of "second side wall") 322 formed at an edge of the first plate portion 321 and coupled to an edge of a bottom surface of the main frame 31. A fixed wrap 323, which forms a compression chamber (V) by being engaged with an orbiting wrap 332, which is discussed hereinafter, may be formed on an upper surface of the first plate portion 321. The compression chamber (V) may be formed between the first plate portion 321 and the fixed wrap 323, and between the orbiting wrap 332, which is discussed hereinafter, and the second plate portion 331. The compression chamber (V) may include a suction chamber, an intermediate pressure chamber, and a discharge chamber consecutively formed in a moving direction of the wrap.

The compression chamber (V) may include a first compression chamber (V1) formed between an inner side surface of the fixed wrap 323 and an outer side surface of the orbiting wrap 332, and a second compression chamber (V2) formed between an outer side surface of the fixed wrap 323 and an inner side surface of the orbiting wrap 332. That is, as shown in FIG. 2, the first compression chamber (V1) may be formed between two contact points (P11, P12) generated as the inner side surface of the fixed wrap 323 and the outer side surface of the orbiting wrap 332 come in contact with each other. Under an assumption that a largest angle among angles formed by two lines which connect a center (O) of an eccentric portion with two contact points (P11, P12) is $\alpha$, a formula ($\alpha<360°$) is formed before a discharge operation is started. The second compression chamber (V2) may be formed between two contact points (P21, P22) generated as the outer side surface of the fixed wrap 323 and the inner side surface of the orbiting wrap 332 come in contact with each other.

The first compression chamber (V1) is formed such that a refrigerant is firstly suctioned thereinto prior to being suctioned into the second compression chamber (V2), and such that a compression path thereof is relatively long. However, as the orbiting wrap 332 is formed with irregularity, a compression ratio of the first compression chamber (V1) is lower than a compression ratio of the second compression chamber (V2). Further, the second compression chamber (V2) is formed such that a refrigerant is later suctioned thereinto after being suctioned into the first compression chamber (V1), and such that a compression path thereof is relatively short. However, as the orbiting wrap 332 is formed with irregularity, the compression ratio of the second compression chamber (V2) is higher than the compression ratio of the first compression chamber (V1).

An inlet 324, through which a refrigerant suction pipe 15 and a suction chamber may communicate with each other, ma be penetratingly-formed at one side of the second side wall portion 322. An outlet 325, that communicates with a discharge chamber and through which a compressed refrigerant may be discharged, may be formed at a central part or portion of the first plate portion 321. The outlet 325 may be formed as one outlet that communicates with both of the first and second compression chambers (V1, V2). Alternatively, a plurality of the outlet 325 may be formed so as to communicate with the first and second compression chambers (V1, V2).

A second shaft accommodation portion 326, configured to support a sub bearing portion 52 of the rotational shaft 5, which is discussed hereinafter, may be formed at a central part or portion of the first plate portion 321 of the fixed scroll 32. A second shaft accommodating hole 326*a*, configured to support the sub bearing portion 52 in the radial direction, may be penetratingly-formed at the second shaft accommodating portion 326 in the axial direction.

A thrust bearing portion 327, configured to support a lower end surface of the sub bearing portion 52 in the axial direction, may be formed at a lower, end of the second shaft accommodation portion 326. The thrust bearing portion 327 may protrude from a lower end of the second shaft accommodating hole 326*a* in the radial direction, towards a shaft center. However, the thrust bearing portion may be formed between a bottom surface of an eccentric portion 53 of the rotational shaft 5, which is discussed hereinafter, and the first, plate portion 321 of the fixed scroll 32 corresponding thereto.

A discharge cover 34, configured to accommodate a refrigerant discharged from the compression chamber (V) therein and to guide the refrigerant to a refrigerant passage which is discussed hereinafter may be coupled to a lower side of the fixed scroll 32. The discharge cover 34 may be formed such that an inner space thereof may accommodate therein the discharge opening 325 and may accommodate therein an inlet of the refrigerant passage ($P_G$) along which a refrigerant discharged from the compression chamber (V1) may be guided to the inner space 1*a* of the casing 1.

The refrigerant passage ($P_G$) may be penetratingly-formed at the second side wall portion 322 of the fixed scroll 32 and the first side wall portion 311 of the main frame 31, sequentially, at an inner side of an oil passage separation portion 8. Alternatively, the refrigerant passage ($P_G$) may be formed so as to be consecutively recessed from an outer circumferential surface of the second side wall portion 322 and an outer circumferential surface of the first frame 311.

The orbiting scroll 33 may be installed or provided between the main frame 31 and the fixed scroll 32 so as to perform an orbiting motion. An Oldham's ring 35 to prevent rotation of the orbiting scroll 33 may be installed or provided between an upper surface of the orbiting scroll 33 and a bottom surface of the main frame 31 corresponding thereto, and a sealing member 36, which forms a back pressure chamber (S), may be installed or provided at an inner side than the Oldham's ring 35. Thus, the back pressure chamber (S) may be implemented as a space formed by the main frame 31, the fixed scroll 32, and the orbiting scroll 33, outside of the sealing member 36. The back pressure chamber (S) forms an intermediate pressure because a refrigerant of an intermediate pressure is filled therein as the back pressure chamber (S) communicates with the intermediate compression chamber (V) by a back pressure hole 321*a* provided at the fixed scroll 32. However, a space formed at an inner side than the sealing member 36 may also serve as a back pressure chamber as oil of high pressure is filled therein.

An orbiting plate portion or orbiting plate (hereinafter, referred to as a "second plate portion" or "second plate") 331 of the orbiting scroll 33 may be formed to have an approximate disc shape. The back pressure chamber (S) may be formed at an upper surface of the second plate portion 331, and the orbiting wrap 332, which forms the compression chamber by being engaged with the fixed wrap 322, may be formed at a bottom surface of the second plate portion 331.

The eccentric portion 53 of the rotational shaft 5, which is discussed hereinafter, may be rotatably inserted into a central part or portion of the second plate portion 331, such that a rotational shaft coupling portion 333 may pass therethrough in the axial direction.

The rotational shaft coupling portion 333 may be extended from the orbiting wrap 332 so as to form an inner end of the orbiting wrap 332. Thus, as the rotational shaft coupling portion 333 is formed to have a height high enough to be overlapped with the orbiting wrap 332 on a same plane, the eccentric portion 53 of the rotational shaft 5 may be overlapped with the orbiting wrap 332 on the same plane. With such a configuration, a repulsive force and a compressive force of a refrigerant may be applied to the same plane on the basis of the second plate portion to be attenuated from each other. This may prevent a tilted state of the orbiting scroll 33 due to the compressive force and the repulsive force.

An outer circumference of the rotational shaft coupling portion 333 may be, connected to the orbiting wrap 332 to form the compression chamber (V) during a compression operation together with the fixed wrap 322. The orbiting wrap 332 may be formed to have an involute shape together with the fixed wrap 323. However, the orbiting wrap 332 may be formed to have various shapes. For example, as shown in FIG. 2, the orbiting wrap 332 and the fixed wrap 323 may be formed to have a shape implemented as a plurality of circles of different diameters and origin points may be connected to each other, and a curved line of an outermost side may be formed as an approximate oval having a long axis and a short axis.

A protrusion 328 that protrudes toward an outer circumference of the rotational shaft coupling portion 333, may be formed near an inner end (a suction end or a starting end) of the fixed wrap 323. A contact portion 328*a* may protrude from the protrusion 328. That is, the inner end of the fixed wrap 323 may be formed to have a greater thickness than other parts. With such a configuration, the inner end of the fixed wrap 323, having the largest compressive force among other parts of the fixed wrap 323, may have an enhanced wrap intensity and may have enhanced durability.

A concaved portion 335, engaged with the protrusion 328 of the fixed wrap 323, may be formed at an outer circumference of the rotational shaft coupling portion 333 which is opposite to the inner end of the fixed wrap 323. A thickness increase portion 335*a*, having its thickness increased from an inner circumferential part or portion of the rotational shaft coupling portion 333 to an outer circumferential part or portion thereof, may be formed at one side of the concaved portion 335, at an upstream side in a direction to form the compression chambers (V). This may enhance a compression ratio of the first compression chamber (V1) by shortening a length of the first compression chamber (V1) prior to a discharge operation.

A circular arc surface 335*b* having a circular arc shape may be formed at another side of the concaved portion 335. A diameter of the circular arc surface 335*b* may be determined by a thickness of the inner end of the fixed wrap 323 and an orbiting radius of the orbiting wrap 332. If the thickness of the inner end of the fixed wrap 323, the diameter of the circular arc surface 335*b* is increased. This may allow the orbiting wrap around the circular arc surface 335*b* to have an increased thickness and thus to obtain durability. Further, as a compression path becomes longer, a compression ratio of the second compression chamber (V2) may be increased in correspondence thereto.

The rotational shaft 5 may be supported in the radial direction as an upper part or portion thereof is forcibly-coupled to a central part or portion of the rotor 22, and as a lower part or portion thereof is coupled to the compression part 3. Thus, the rotational shaft 5 transmits a rotational force of the motor part 2 to the orbiting scroll 33 of the compression part 3. As a result, the orbiting scroll 33 eccentrically-coupled to the rotational shaft 5 performs an orbiting motion with respect to the fixed scroll 32.

The main bearing portion 51, supported in the radial direction by being inserted into the first shaft accommodating hole 312*a* of the main frame 31, may be formed at a lower part or portion of the rotational shaft 5. The sub bearing portion 52, supported in the radial direction by being inserted into the second shaft accommodating hole 326*a* of the fixed scroll 32, may be formed below the main bearing portion 51. The eccentric portion 53, inserted into the rotational shaft coupling portion 333 of the orbiting scroll 33, may be formed between the main bearing portion 51 and the sub bearing portion 52.

The main bearing portion 51 and the sub bearing portion 52 may be formed to be concentric with each other, and the eccentric portion 53 may be formed to be eccentric from the main bearing portion 51 or the sub bearing portion 52 in the radial direction. The sub bearing portion 52 may be formed to be eccentric from the main bearing portion 51.

An outer diameter of the eccentric portion 53 may be formed to be mailer than a diameter of the main bearing portion 51, but larger than a diameter of the sub bearing portion 52, such that the rotational shaft 5 may be easily coupled to the eccentric portion 53 through the shaft accommodating holes 312*a*, 326*a*, and the rotational shaft coupling portion 333. However, in a case of forming the eccentric portion 53 using an additional bearing without integrally forming the eccentric portion 53 with the rotational shaft 5, the rotational shaft 5 may be coupled, to the eccentric portion 53, without the configuration that the outer diameter of the eccentric portion 53 is larger than the diameter of the sub bearing portion 52.

An oil supply passage 5*a*, along which oil may be supplied to the bearing portions and the eccentric portion, may be formed in the rotational shaft 5. As the compression part 3 is disposed below the motor part 2, the oil supply passage 5*a* may be formed in a chamfering manner from a lower end of the rotational shaft 5 to a lower end of the stator 21 or to an intermediate height of the stator 1, or to a height higher than an upper end of the main bearing portion 51.

An oil feeder 6, configured to pump oil contained in the oil storage space 1*b*, may be coupled to a lower end of the rotational shaft 5, that is, a lower end of the sub bearing portion 52. The oil feeder 6 may include an oil supply pipe 61 insertion-coupled to the oil supply passage 5*a* of the rotational shaft 5, and an oil suctioning member 62, for example, propeller, inserted into the oil supply pipe 61 and configured to suction oil. The oil supply pipe 61 may be installed or provided to be immersed in the coil storage space 1*b* via a though hole 341 of the discharge cover 34.

An oil supply hole and/or an oil supply groove, configured to supply oil suctioned through the oil supply passage to an outer circumferential surface of each of the respective bearing portions and the eccentric portion, may be formed at the respective bearing portions and the eccentric portion, or at a position between the respective bearing portions.

For example, as shown in FIGS. 1 and 4, a first small diameter portion 54, configured to separate the main bearing portion 51 and the eccentric portion 53 from each other by a predetermined interval therebetween, may be formed below the main bearing portion 51. A first oil supply hole 551 may be formed at the first diameter portion 54, so as to penetrate from the oil supply passage 51 towards an outer circumferential surface of the first diameter portion 54. A first oil supply groove 552 may be formed on an outer circumferential surface of the main bearing portion 51, such that oil supplied to the first diameter portion 54 through the first oil supply hole 551 may flow to an upper side along the outer circumferential surface of the main bearing portion 51 to lubricate a bearing surface.

With such a configuration, oil suctioned toward an upper end of the main bearing portion 51 along the first oil supply groove 552 flows out of the bearing surface from an upper end of the first shaft accommodating portion 312 of the main frame 31. Then, the oil flows down onto an upper surface of the main frame 31, along the first shaft accommodating portion 312. Then, the oil is collected in the oil storage space 1*b*, through an oil passage ($P_O$) consecutively formed on an outer circumferential surface of the main frame 31 (or through a groove that communicates from the upper surface of the main frame 31 to the outer circumferential surface of the main frame 31) and an outer circumferential surface of the fixed scroll 32. Further, oil, discharged to the inner space 1*a* of the casing 1 from the compression chamber (V) together with a refrigerant, is separated from the refrigerant at an upper space of the casing 1. Then, the oil is collected in the oil storage space 1*b*, through a passage formed on an outer circumferential surface of the motor part 2, and through the oil passage ($P_O$) formed on an outer circumferential surface of the compression part 3.

A second oil supply hole 553 that communicates with the oil supply passage 5*a* may be penetratingly-formed at the rotational shaft, above the sub bearing portion 52. A second oil supply groove 554, that communicates with the second oil supply hole 553, may be formed to extend length wise on an outer circumferential surface of the sub bearing portion 52 in upper and lower directions.

An upper end of the second oil supply groove 554 may communicate with a second small diameter portion 55 between the sub bearing portion 52 and the eccentric portion 53. A position of the second oil supply hole 553 and a shape of the second oil supply groove 554 may be various, such as, for example, a spiral shape.

With such a configuration, oil suctioned along the oil supply passage 5*a*, may partially flow to the sub bearing portion 52 through the second oil supply hole 553, thereby lubricating a space between the sub bearing portion 52 and the second shaft accommodating hole 326*a*. Then, a part or portion of the oil may be upwardly moved along the second oil supply groove 554, thereby lubricating a space between a bottom surface of the eccentric portion 53 and the plate surface of the fixed scroll 32, and a space between an outer circumferential surface of the eccentric portion 53 and an inner circumferential surface of the rotational shaft coupling portion 333. In a case of forming an additional third oil supply hole 556 and a third oil supply groove (not shown) on an outer circumferential surface of the eccentric portion 53, oil may be introduced to a space between an outer circumferential surface of the eccentric portion and an inner circumferential surface of the rotation shaft coupling portion, through the third oil supply hole 556 and the third oil supply groove. This may allow a lubrication operation to be performed more effectively.

Figure 5:
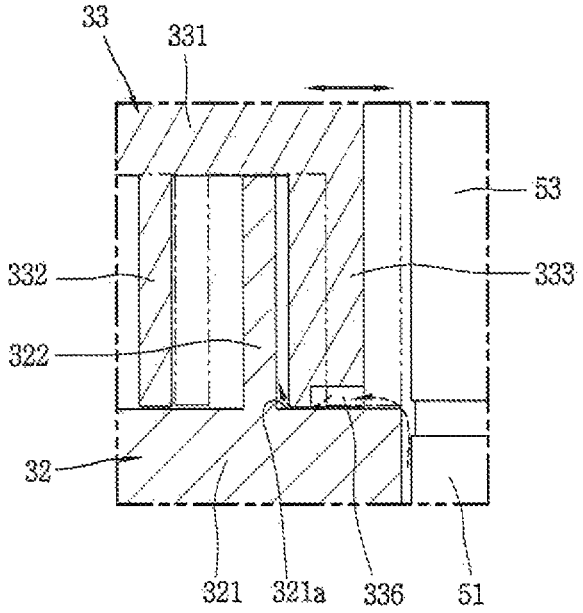
FIG. 5 is a longitudinal sectional view illustrating a process of lubricating contact surfaces of an orbiting scroll and a fixed scroll, in the scroll compressor of FIG. 1.
Figure 6:
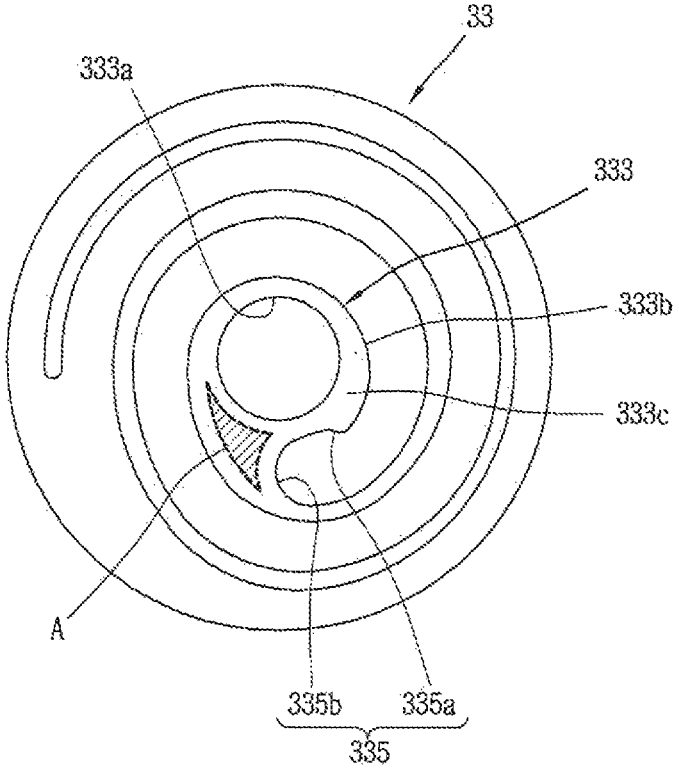
FIG. 6 is a planar view of the orbiting scroll for explaining an oil supply inferior region among an end surface of a rotational shaft coupling portion, in the scroll compressor of FIG. 1.

FIG. 5 is a longitudinal sectional view illustrating a process of lubricating contact surfaces of the orbiting scroll and the fixed scroll, while the orbiting scroll performs an orbiting motion in the scroll compressor of FIG. 1. FIG. 6 is a planar view of the orbiting scroll for explaining an oil supply inferior region among an end surface of the rotational shaft coupling portion in the scroll compressor of FIG. 1.

As shown, oil introduced into a space between a bottom surface of the eccentric portion 53 and the plate surface of the fixed scroll 32, lubricates contact surfaces of the orbiting scroll 33 and the fixed scroll 32, as an end surface (a wrap tip surface) of the orbiting wrap 332 moves oil which remains on a plate surface 321*a* of the first plate surface 321, which is positioned at an inner side of the wrap, to an outer side of the wrap, while the orbiting scroll 33 performs an orbiting motion, in order for oil to smoothly move between the two wraps, a wrap thickness should be smaller at least than an orbiting radius of the orbiting scroll. This may allow an entire region of a wrap end surface to be lubricated.

However, as shown in FIG. 6, a wrap thickness of the orbiting wrap may be larger than the orbiting radius (r), at a region of a peripheral end surface, defined as, an end surface between an inner circumferential part or portion 333*a* and an outer circumferential part or portion 333*b* of the rotational shaft coupling portion 333, for example, at a region near a circular arc surface 335*b* formed at the outer circumferential part 333*b* of the rotational shaft coupling portion 333. This may cause abrasion as well as a frictional loss, as oil is not introduced into the peripheral end surface 333*c* of the rotational shaft coupling portion 333.

That is, in the orbiting scroll 33 according to this embodiment, as the rotational shaft coupling portion 333 to couple the rotational shaft 5 thereto is formed at an inner end (starting end) of the orbiting wrap 332, the peripheral end surface 333*c* of the rotational shaft coupling portion 333 also contacts the plate surface 321*a* of the fixed scroll 32 (an upper surface of the first plate surface). Therefore, oil should also be introduced to a space between the peripheral end surface 333*c* of the rotational shaft coupling portion 333 and the plate surface 321*a* of the fixed scroll 32, in order to prevent friction therebetween. However, among the peripheral end surface 333*c* of the rotational shaft coupling portion 333, there exists a region larger than the orbiting radius (r) (a region 'A' indicated by inclined, lines in FIG. 6). The region 'A' is an oil supply inferior region to which oil is not smoothly supplied even when the orbiting scroll 33 performs an orbiting motion. Thus, dry abrasion may occur on a part or portion of the peripheral end surface 333*c* of the rotational shaft coupling portion 333, or on the plate surface 321*a* of the fixed scroll 32, which is disposed, within the orbiting radius.

Especially, when the fixed scroll 32 is formed of cast-iron and the orbiting scroll 33 is formed of a material lighter and softer than a material of the fixed scroll 32 for example, aluminum the peripheral end surface 333*c* of the rotational shaft coupling, portion 333 may be severely abraded. If the rotational shaft coupling portion 333 of the orbiting scroll 33 or the plate surface 321*a* of the fixed scroll 32 corresponding thereto is abraded, the orbiting scroll 33 has an unstable behavior, and a high pressure refrigerant compressed in the compression chamber (V) leaks to an abraded region to lower compression efficiency. Further, the high pressure refrigerant which leaks to a space between the peripheral end surface 333*c* of the rotational shaft coupling portion 333 and the plate surface 321*a* of the fixed scroll 32, is introduced into a space between the sub bearing portion 52 of the rotational shaft 5 and an inner circumferential surface of the second shaft accommodating hole 326*a*. As the high pressure refrigerant blocks the second oil supply hole 553, oil is not smoothly supplied to a space between the sub bearing portion 52 and the second shaft accommodating hole 326*a*, resulting in increasing a frictional loss.

Figure 7:
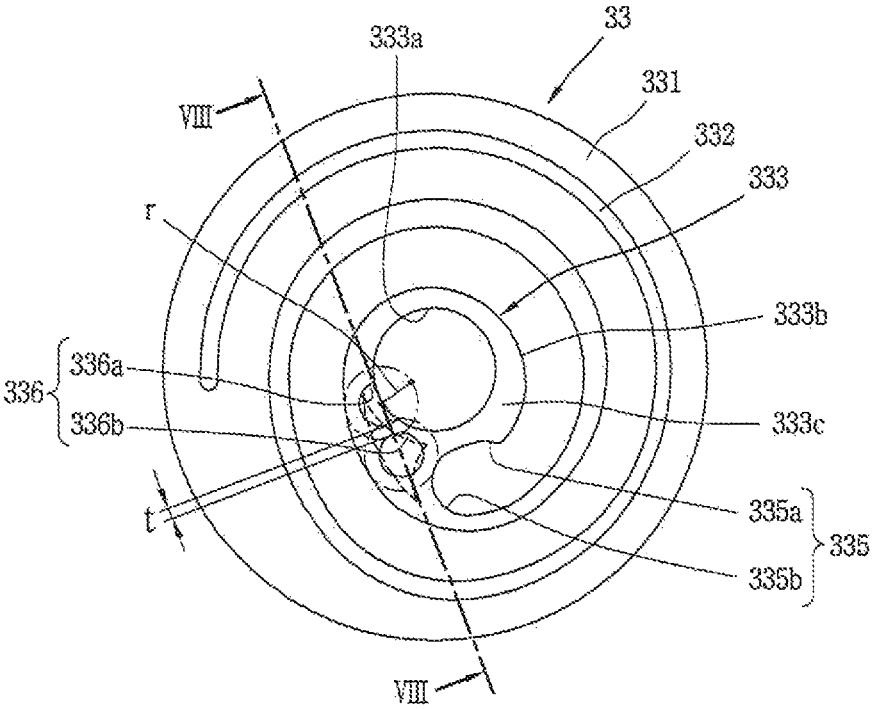
FIG. 7 is a planar view of the orbiting scroll, which illustrates a structure to supply oil to an oil supply inferior region among an end surface of the rotational shaft coupling portion, the scroll compressor of FIG. 1.
Figure 8:
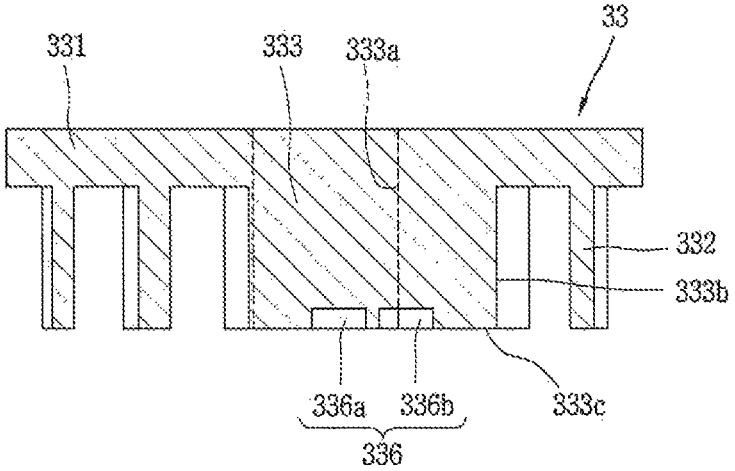
FIG. 8 is a sectional view taken along line 'VIII-VIII' in FIG. 7.

In this embodiment, as shown in FIGS. 7 and 8, an oil dimple 336 having a predetermined area and depth may be formed at an end surface of the orbiting wrap 33, at a region at which a width (wrap thickness) of the end surface in an orbiting radius direction is equal to or larger than the orbiting radius (r). The oil dimple 336 may be formed so as to communicate with the rotational shaft coupling portion 333, by chamfering an edge of an inner circumferential part or portion of the rotational shaft coupling portion 333. With such a configuration, oil suctioned to the eccentric portion of the rotational shaft and an inner circumferential surface of the rotational shaft coupling portion, may be introduced into the peripheral end surface of the rotational shaft coupling, portion along the oil dimple. This may allow oil to be smoothly supplied even to a region having a width greater than the orbiting radius.

Figure 9A:
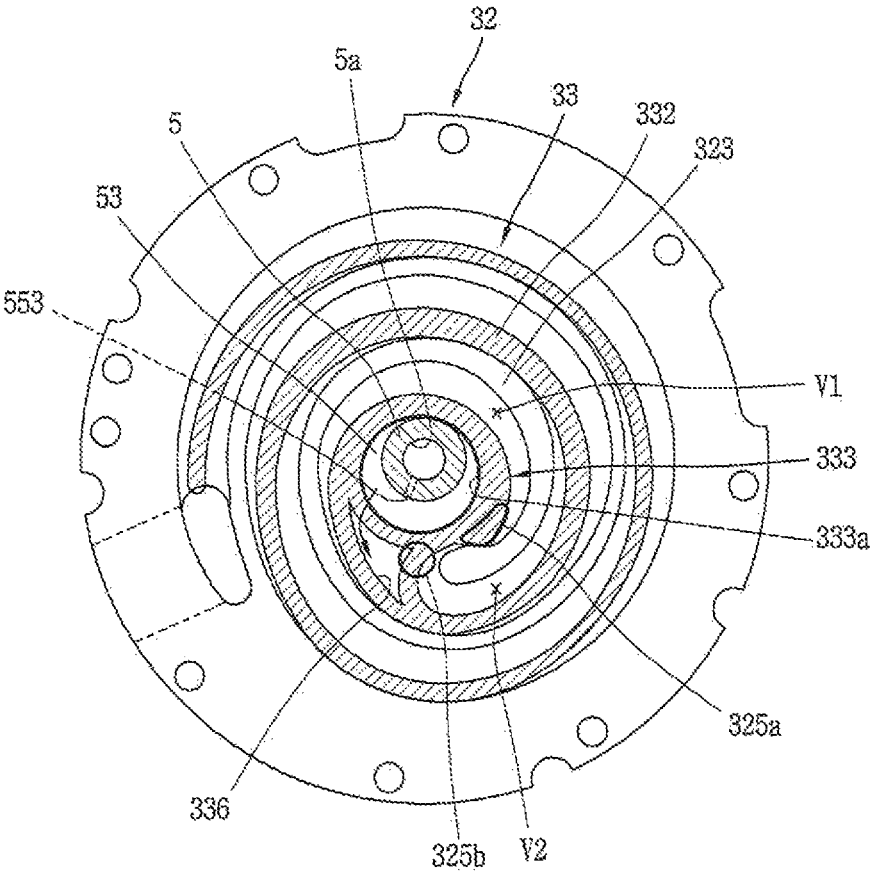

As shown in FIG. 9A, the oil dimple 336 may be formed at the oil supply inferior region (A) shown in FIG. 6. The oil dimple 336 may not directly communicate with the inner circumferential part 333*a* of the rotational shaft coupling portion 333. However, when the orbiting scroll 33 performs an orbiting movement, oil of the rotational shaft coupling portion 333 may move to the oil dimple 336 in a contacted state onto the peripheral end surface 333*c* of the rotational shaft coupling portion 333, due to a narrow gap between the rotational shaft coupling portion 333 and the oil dimple 336.

One oil dimple 336 may be formed to extend lengthwise in a widthwise direction. Alternatively, a plurality of oil dimples 336*a*, 336*b* may be formed with a predetermined gap (t) therebetween, for prevention of leakage of a discharged refrigerant to the rotational shaft coupling portion 333 through the oil dimple 336.

Figure 9B:
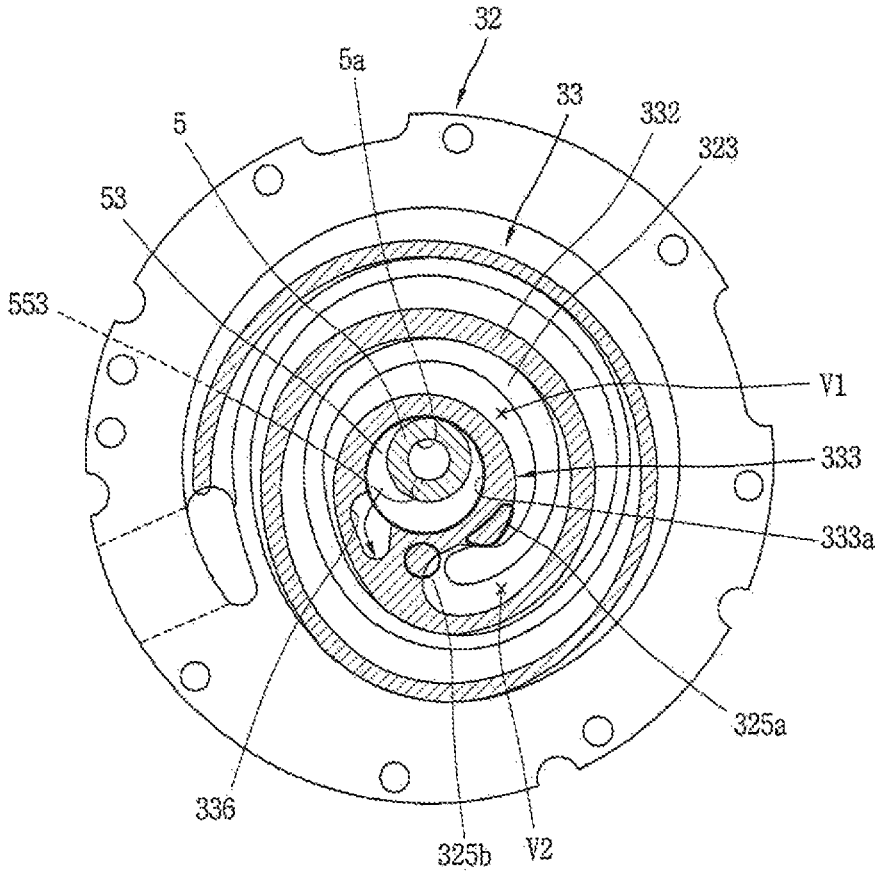
Figure 9C:
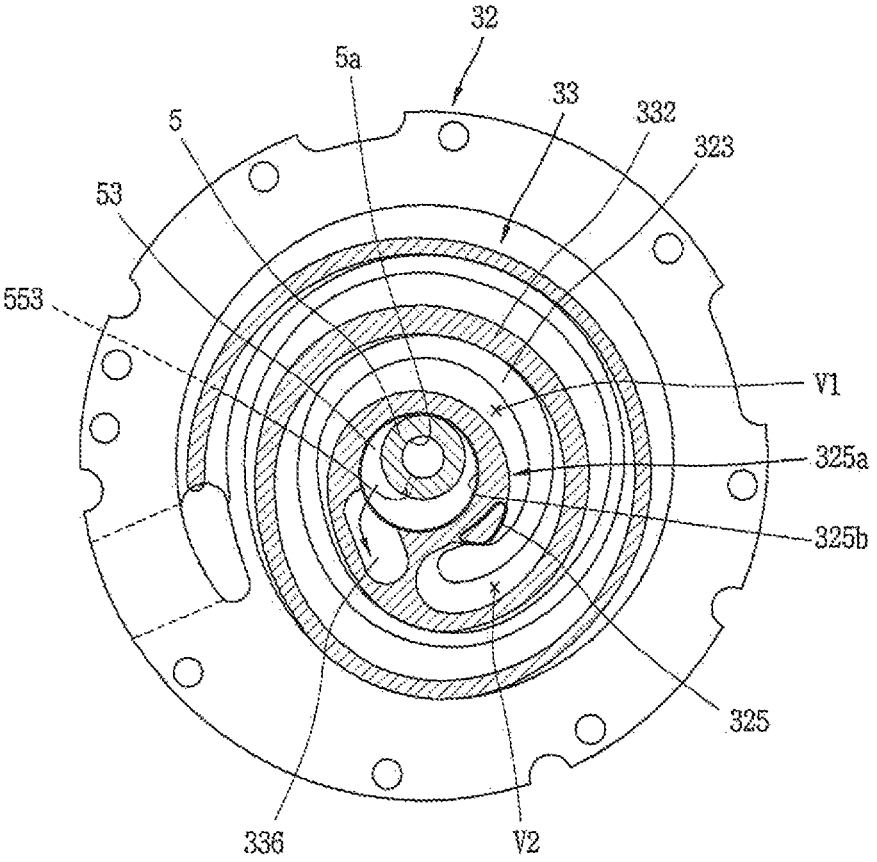

For example, as shown in FIGS. 9B and 9C, when the oil dimple 336 is formed as one, one, side of the oil dimple 336 may communicate with the rotational shaft coupling portion 333. If another side of the oil dimple 336 communicates with the outlet 325, a refrigerant discharged to the outlet 325 from the compression chamber (V) may be partially introduced into the oil dimple 336. Then, the refrigerant may backflow to the rotational shaft coupling portion 333 by a pressure difference. This may cause a fictional loss as well as a compression loss, the frictional loss resulting from an oil deficiency occurring as the backflowing refrigerant blocks the second oil supply hole 553. Therefore, in a case of forming one oil dimple 336, the oil dimple 336 may be formed at a region closest to the outlet 325*b*, within a range where the oil dimple 336 does not communicate with the outlet 325*b* even when the orbiting scroll 33 performs an orbiting movement.

In a case in which one oil dimple 336 is formed, if one outlet 325 is formed as shown in FIG. 9C, the oil dimple 336 may not communicate with the outlet 325 even though the oil dimple 336 is formed to extend lengthwise. However in this case, as the outlet 325 is formed near the first compression chamber (V1), a refrigerant inside of the second compression chamber (V2) may have as increased discharge resistance. This may lower compression efficiency.

Figure 9D:
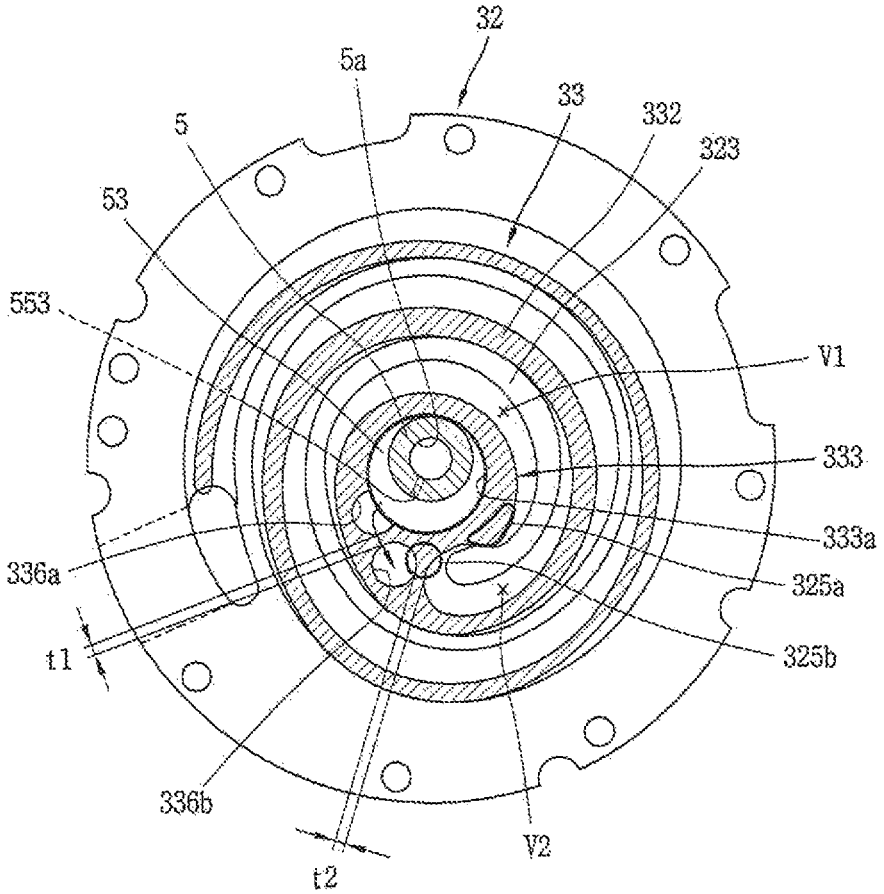

Therefore, as shown in FIG. 9D, a plurality of outlets 325*a*, 325*b* may be formed in correspondence to the first and second compression chambers (V1, V2), respectively, and to form a plurality of oil dimples 336*a*, 336*b* in order to prevent a discharged refrigerant from backflowing to the rotational shaft coupling portion 333. Here, the oil dimples 336*a*, 336*b* may be formed with a predetermined gap (t) therebetween.

For example, the oil dimple 336*a* which communicates with the inner circumferential part 333*a* of the rotational shaft coupling portion 333 (hereinafter, the "first all dimple") may be formed to have an interval (t1) smaller than or equal to the orbiting radius (r), from the other oil dimple 336*b* (hereinafter, the "second oil supply groove"). With such a configuration as the first and second oil dimples 336*a*, 336*b* share the plate surface 321*a* of the fixed scroll 32 corresponding thereto when the orbiting scroll 33 performs an orbiting movement, oil induced by the first oil dimple 326*a* may move in a contained state in the second oil dimple 336*b*. Accordingly, oil which has moved towards the outer circumferential part of the rotational shaft coupling portion 333 by the first oil dimple 336*a* may be transferred to the second oil dimple 336*b*. Then, the oil may lubricate the oil supply inferior region 'A' of the rotational shaft coupling portion 333, while moving towards the outer circumferential part of the rotational shaft coupling portion 333.

A shortest distance (t2) between the second oil dimple 336*b* and an edge of the outer circumferential part 333*b* of the rotation shaft coupling portion 333 may also be formed to be equal to or smaller than the orbiting radius (r), for minimization of the oil supply inferior region (a region of the peripheral end surface 333*c* of the rotational shaft coupling portion 333 to which oil is not supplied).

Another embodiment of a scroll compressor according to an embodiment will be explained hereinafter.

Figure 10:
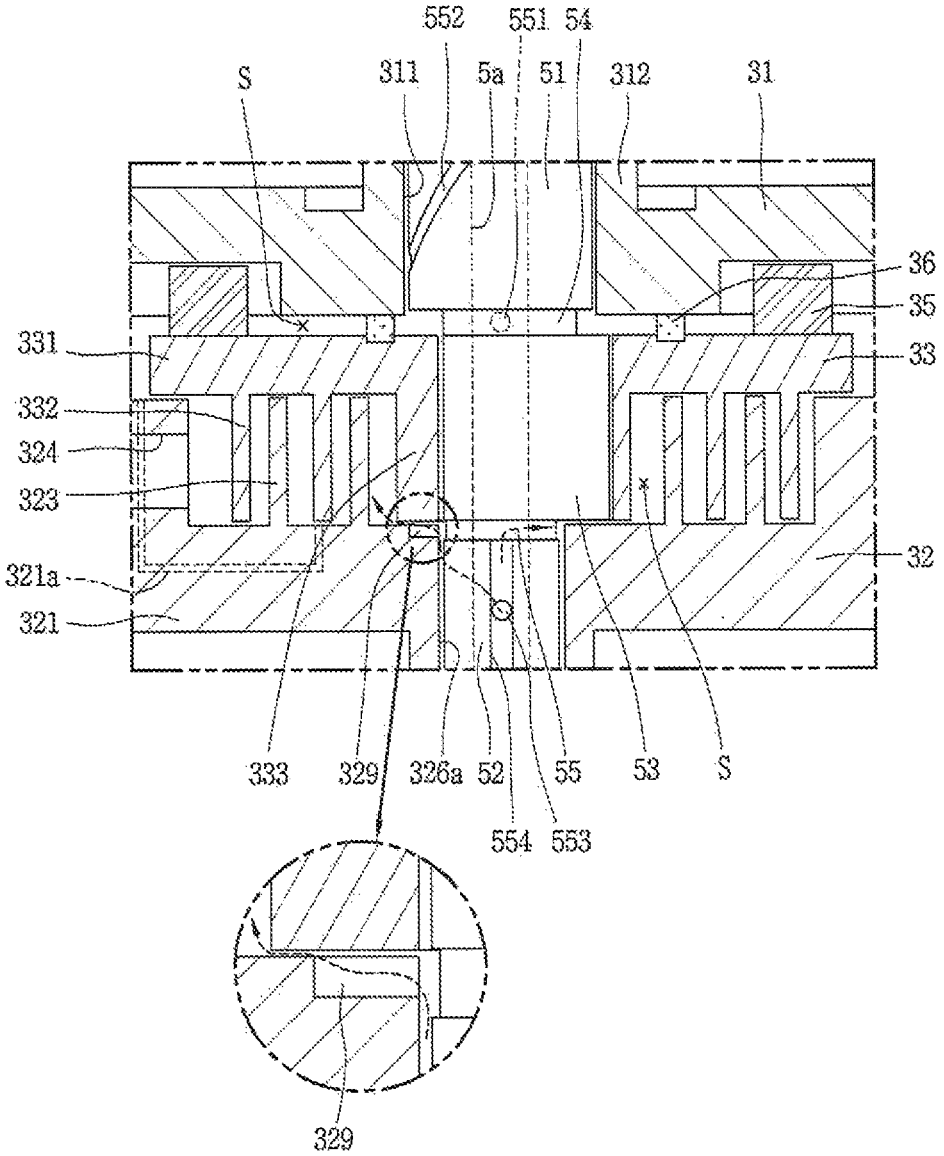
FIGS. 10 and 11 are a longitudinal sectional view and a planar view, respectively, illustrating an example that an oil dimple is formed at a fixed scroll, in a scroll compressor according to an embodiment.
Figure 11:
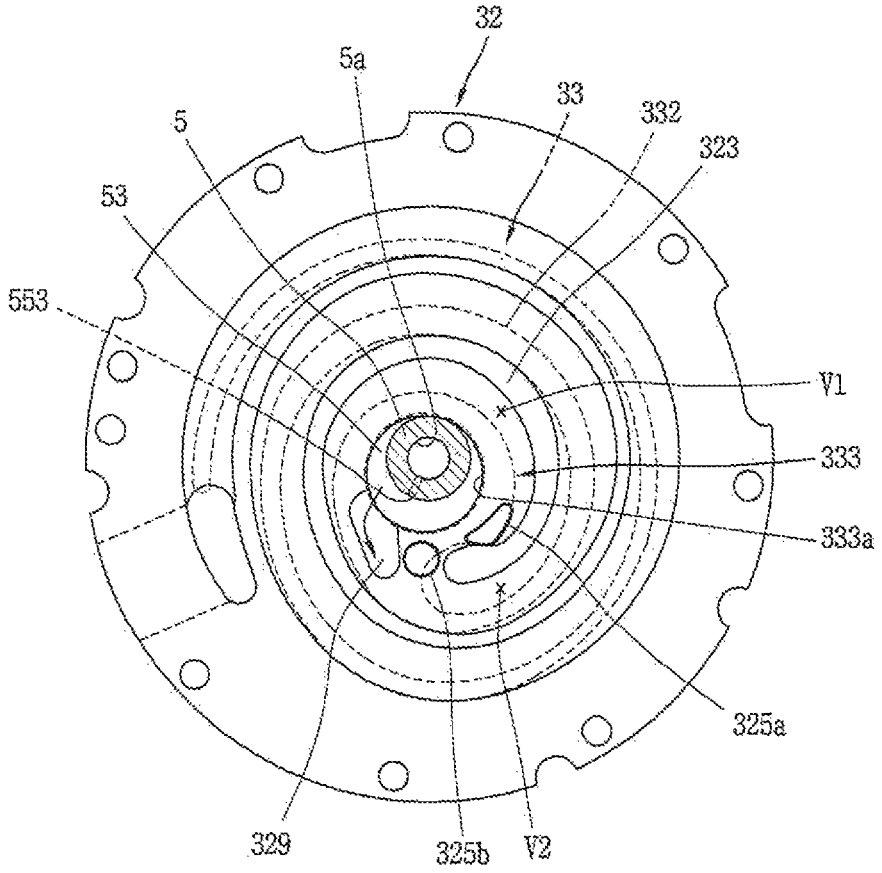

That is, in the aforementioned embodiment, the oil dimple is formed at the peripheral end surface of the rotational shaft coupling portion formed at the orbiting scroll. However, in this embodiment, as shown in FIGS. 10 and 11, an oil dimple 329 may be formed at, the plate surface 321*a* of the fixed scroll 32 corresponding to the peripheral end surface 333*c* of the rotational shaft coupling portion 333.

In this case, for smooth oil supply, the oil dimple 329 may be formed at a position at which it communicates with the inner circumferential part 333*a* of the rotational shaft coupling portion 333 when the orbiting scroll 33 performs an orbiting movement. In this case, one oil dimple (not shown) may be formed to extend lengthwise. Alternatively, a plurality of oil dimples 329 may be formed with an interval therebetween equal to or smaller than the orbiting radius. If one oily dimple is formed, the oil dimple may be formed at a position at which it does not communicate with the outlet. On the other hand, if a plurality of oil dimples are formed, an oil dimple that communicates with the rotational shaft coupling portion may be formed to have a predetermined gap from an oil, dimple that communicates with the outlet, for prevention of communication.

As a basic configuration and effects of this embodiment may be same as or similar to those of the aforementioned embodiment, detailed explanations thereof has been omitted. In this embodiment, as the oil dimple is formed at the fixed scroll having the outlet, it may be properly arranged with consideration of a position of the outlet.

Still another embodiment of the scroll compressor according to an embodiment will be explained hereinafter.

In the aforementioned embodiments, a lower end of the rotational shaft is supported at the thrust bearing portion of a sub frame. However, in this embodiment, as shown in FIGS. 12 and 13, a bottom surface 53*a* of the eccentric portion 53 may be supported at the plate surface 321*a* of the fixed scroll 32 in the axial direction, oil may be smoothly introduced to the peripheral end surface 333*c* of the rotational shaft coupling portion 333, as well as the bottom surface 53*a* of the eccentric portion 53.

Figure 12:
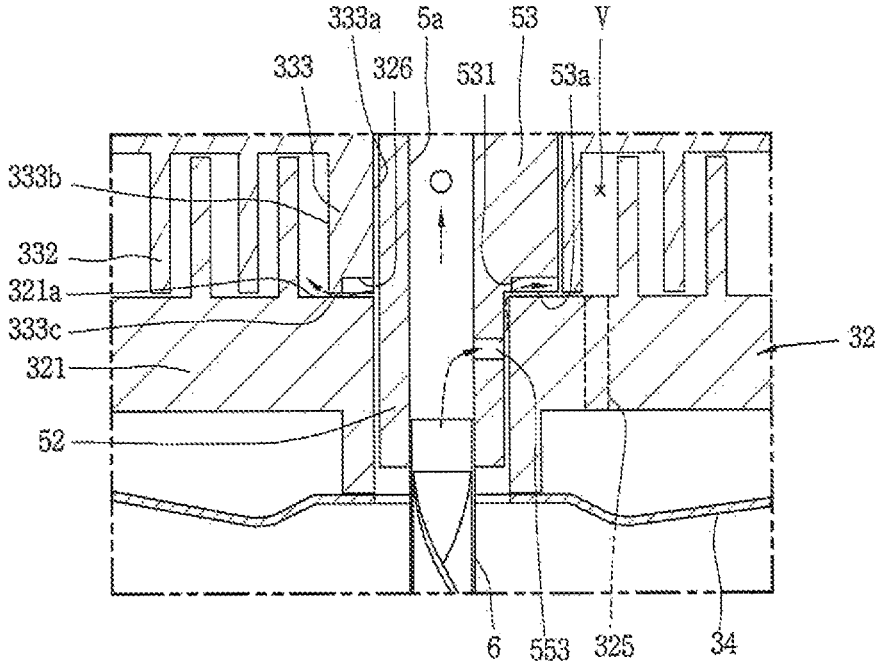
FIGS. 12 and 13 are longitudinal sectional view and a sectional view, respectively, illustrating an example of forming an eccentric portion oil supply groove to supply oil to a lower surface of an eccentric portion, in a case in which the lower surface of the eccentric portion forms a thrust surface, in a scroll compressor according to an embodiment.
Figure 13:
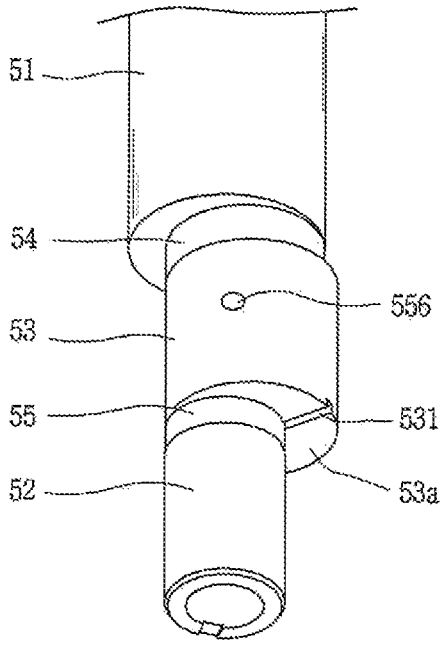

For this, in this embodiment, as shown in FIG. 12, an eccentric portion oil supply groove 531 may be further formed at the bottom surface 53*a* of the eccentric portion 53. As a result, as shown in FIG. 13, oil supplied to the rotational shaft coupling portion 333 may be smoothly introduced to a space between the bottom surface 53*a* of the eccentric portion 53 and the plate surface 321*a* of the fixed scroll 32 corresponding thereto, along the eccentric portion oil supply groove 531 of the eccentric portion 53. The oil used for lubrication may be effectively supplied even to a space between the peripheral end surface 333*c* of the rotational shaft coupling portion 333 and the plate surface 321*a* of the fixed scroll 32.

In this case, if the aforementioned oil dimples 336*a*, 336*b*, 329 are formed at the peripheral end surface 333*c* of the rotational shaft coupling portion 333 or the plate surface 321*a* of the fixed scroll 32 corresponding thereto, oil may be smoothly supplied even to a region among the peripheral end surface 333*c* of the rotational shaft coupling portion 333, the region at which a width in the orbiting radius direction is larger than or equal to the orbiting radius. This may prevent abrasion at the region.

Embodiments disclosed herein provide a scroll compressor capable of enhancing a reliability in a condition of a high compression ratio, by preventing occurrence of abrasion at a region among contact surfaces of a fixed scroll and an orbiting scroll, the region where a wrap thickness is greater than an orbiting radius. Embodiments disclosed herein further provide a scroll compressor capable of preventing abrasion by smoothly introducing oil into the aforementioned region.

Embodiments disclosed herein also provide a scroll compressor capable of smoothly introducing oil into the aforementioned region, and capable of preventing a compressed refrigerant from leaking to an oil supply passage. Embodiments disclosed herein additionally provide a scroll compressor capable of smoothly introducing oil into the aforementioned region and a bottom surface of an eccentric portion, even when the bottom surface of the eccentric portion forms a thrust bearing surface.

Embodiments disclosed herein provide a scroll compressor that may include a fixed scroll having a fixed wrap; an orbiting scroll having an orbiting wrap to form a compression chamber by being engaged with the fixed wrap, and having, a rotational shaft coupling portion penetratingly-formed at an inner end of the orbiting wrap; and a rotational shaft coupled to the rotational shaft coupling portion, and around which the orbiting scroll performs an orbiting motion. One or more grooves may be formed at a region among an end surface of the orbiting wrap, the region where a wrap thickness is greater than an orbiting radius of the orbiting scroll. This may allow oil contained in the groove provided at the wrap end surface, to be moved in a wrap thickness direction. Accordingly, oil may be smoothly introduced even to a region having a great width among a wrap end surface.

The groove may be formed so as to communicate with an inner circumferential part of the rotational shaft coupling portion. The groove may be formed between an inner edge and an outer edge of the rotational shaft coupling portion, and may be formed so as to be connected to one of the inner and outer edges and to be disconnected from another thereof. With, such a configuration, oil may be smoothly introduced into a peripheral end surface of the rotational shaft coupling portion having a relatively great wrap thickness, and a compressed refrigerant of high pressure may be prevented from leaking to the rotational shaft coupling portion. This may prevent lowering of efficiency of the scroll compressor.

The groove may be formed in plurality in number, and at least one of the plurality of grooves may communicate with the rotational shaft coupling portion. Another groove may be spaced from the at least one groove by an interval equal to or smaller than an orbiting radius. With such a configuration, when one groove communicates with an outlet, a discharged refrigerant may be prevented from backflowing to an oil supply passage. This may prevent lowering of efficiency of the scroll compressor.

The oil supply passage may be formed at a bottom surface of an eccentric portion. With such a configuration, even when the eccentric portion forms a thrust surface, oil may be smoothly supplied to the rotational shaft coupling portion, as well as the bottom surface of the eccentric portion.

Embodiments disclosed herein provide a scroll compressor that may include a casing configured to contain oil at a lower part or portion thereof; a drive motor provided at an inner space of the casing; a rotational shaft coupled to a rotor of the drive motor, and having an oil supply passage in order to guide the oil contained in the casing to an upper side; a frame provided below the drive motor; a fixed scroll provided below the frame, and having a fixed wrap; and an orbiting scroll disposed or provided between the frame and the fixed scroll, having an orbiting wrap to form a compression chamber by being engaged with the fixed wrap, and having a rotational shaft coupling portion to couple the rotational shaft thereto in a penetrating manner. One or more oil dimples may be formed at an end surface of the orbiting wrap between an inner circumferential part or portion and an outer circumferential part or portion of the rotational shaft coupling portion.

The oil dimple may be formed at a region where an interval between the inner circumferential part and the outer circumferential part of the rotational shaft coupling portion is larger than an orbiting radius of the orbiting scroll. With such a configuration even if a specific part or portion, does not reach an oil region when the orbiting scroll performs an orbiting motion, oil may be induced by the oil dimple. This may allow oil to be sufficiently supplied even to a region having a width greater than an orbiting radius.

The oil dimple may communicate with the inner circumferential part of the rotational shaft coupling portion. With such a configuration, oil supplied through the rotational shaft coupling portion may be rapidly guided to the oil dimple thereby being smoothly supplied to the aforementioned region.

The oil dimple may be formed in plurality, and an interval between the oil dimples may be equal to or smaller than an orbiting radius. With such a configuration, oil may be smoothly moved among the plurality of oil dimples.

At least one of the plurality of oil dimples may communicate with the inner circumferential part of the rotational shaft coupling portion. Another groove may be spaced from the outer circumferential part of the rotational shaft coupling portion. With such a configuration, a discharged refrigerant may be prevented from backflowing to the rotational shaft coupling portion.

At least one outlet, that communicates with the compression chamber and through which a refrigerant compressed in the compression chamber is discharged, may be provided at the fixed scroll. An interval between an coil dimple that communicates with the inner circumferential part of the rotational shaft coupling portion and the outlet may be equal to or larger than an orbiting radius.

An eccentric portion inserted into the inner circumferential part of the rotational shaft coupling portion may be formed at the rotational shaft, and an oil supply groove may be formed at one side surface of two side surfaces of the eccentric portion in an axial direction so as to communicate with an outer circumferential surface of the eccentric portion the one side surface contacting a plate surface of the fixed scroll. With such a configuration, even if a bottom surface of the eccentric portion forms a thrust bearing surface, oil may be smoothly introduced into the thrust bearing surface of the eccentric portion for lubrication. The oil may be rapidly introduced even into the rotational shaft coupling portion.

A shaft accommodating hole to support the rotational shaft in a penetrating manner may be formed at the fixed scroll, and an oil supply passage may be formed in the rotational shaft. An oil supply hole to guide oil to a space between the oil supply passage and the shaft accommodating hole of the fixed scroll may be formed at an intermediate part or portion of the oil supply passage.

Embodiments disclosed herein provide a scroll compressor that may include a fixed scroll having a fixed plate surface, a fixed wrap that protrudes from the fixed plate surface, and one or more outlets formed near an inner end of the fixed wrap; and an orbiting scroll having an orbiting plate surface provided with a rotational shaft coupling portion to eccentrically-couple a rotational shaft in an insertion manner, and having an orbiting wrap that protrudes from the orbiting plate surface and engaged with the fixed wrap, the orbiting wrap which forms a compression chamber including, a suction chamber, an intermediate pressure, chamber, and a discharge chamber, together with the fixed plate surface, the fixed wrap, and the orbiting plate surface, while performing an orbiting motion with respect to the fixed wrap. An oil dimple may be formed at a region of an end surface of the fixed wrap or the orbiting wrap, the region where a wrap thickness is greater than an orbiting radius of the orbiting scroll.

The rotational shaft coupling portion may be formed to penetrate an inner end of the orbiting wrap, and the oil dimple may be formed at a wrap end surface near the rotational shaft coupling portion, so as to communicate with the inner circumferential part of the rotational shaft coupling portion. The oil dimple that communicates with the inner circumferential part of the rotational shaft coupling portion may be spaced from the outlet by an interval larger than an orbiting radius. The oil dimple may be formed in plurality in number, and an interval between the oil dimples may be equal to or larger than the orbiting radius.

At least one of the plurality of oil dimples may communicate with the inner circumferential part of the rotational shaft coupling portion, and another of the plurality of oil dimples may be spaced from an outer circumferential surface of the rotational shaft coupling portion by an interval smaller than the orbiting radius. The oil dimple may be formed at an end surface positioned between an inner circumferential part or portion and an outer circumferential part or portion of the rotational shaft coupling portion.

Embodiments disclosed herein provide a scroll compressor that may include a casing configured to contain oil at a lower part or portion thereof; a drive motor provided at an inner space of the casing; a rotational shaft coupled to the drive motor, and having an oil supply passage in order to guide the oil contained in the casing to an upper side; a frame provided below the drive motor, and having a first shaft accommodating hole to couple the rotational shaft in a penetrating manner; a fixed scroll provided below the frame, having a second shaft accommodating hole to couple the rotational shaft in a penetrating manner, and having a fixed wrap; and an orbiting scroll disposed or provided between the frame and the fixed scroll, having a rotational shaft coupling portion to couple the rotational shaft thereto, and having an orbiting wrap to form a compression chamber by being engaged with the fixed wrap. One or more oil dimples that communicates with the second shaft accommodating hole may be formed at the fixed scroll corresponding to an end surface of the rotational shaft coupling portion.

An oil dimple may be formed at the end surface of the rotational shaft coupling portion between an inner circumferential, part or portion and an outer circumferential part or portion. One or more outlets, through which a compressed refrigerant is discharged, may be provided at the fixed scroll, and the oil dimple may be spaced from the outlet.

An oil dimple may be formed at an end surface of the rotational shaft coupling, portion between an inner circumferential part or portion and an outer circumferential part or portion, and the oil dimple may communicate with the inner circumferential part of the rotational shaft coupling portion.

The compression chamber may include a first compression chamber formed on an inner side surface of the fixed wrap, and a second compression chamber formed on an outer side surface of the fixed wrap. The first compression chamber may be defined between two contact points P11 and P12 generated as the inner side surface, of the fixed wrap contacts an outer side surface of the orbiting wrap. A formula of $0° < \alpha < 360°$ may be formed, wherein a is an angle defined by two lines which connect a center O of the eccentric portion to the two contact points P1 and P2, respectively.

In the scroll compressor according to embodiments disclosed herein, as the oil supply groove is formed at a region among contact surfaces of the fixed scroll and the orbiting scroll, the region where a wrap thickness is greater than an orbiting radius. This may prevent occurrence of abrasion at the region, thereby enhancing a reliability in a condition of a high compression ratio.

Further, as the oil supply groove communicates with the inner circumferential part of the rotational shaft coupling portion, oil may be smoothly introduced into the aforementioned region. This may prevent occurrence of abrasion at the region.

Furthermore, as the oil supply groove does not communicate with the outlet, oil may be smoothly introduced into the aforementioned, region, and a compressed refrigerant may be prevented from leaking to an oil supply passage.

Also, when a bottom surface of the eccentric portion forms a thrust bearing surface, the al supply groove may be formed at the bottom surface of the eccentric portion. This may allow oil to be smoothly introduced into the aforementioned region and the bottom surface of the eccentric portion.

Further scope of applicability of the present application will become more apparent from the detailed description given. However, it should be understood that the detailed description and specific examples, while indicating embodiments, are given by way of illustration only, since various changes and modifications within the spirit and scope will become apparent to those skilled in the art from the detailed description.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled, in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing configured to contain oil at a lower part portion thereof;

a drive motor provided at an inner space of the casing;

a rotational shaft coupled to a rotor of the driving drive motor, and having an oil supply passage in order to guide the oil contained in the casing to an upper side;

a fixed scroll provided below the driving drive motor, and having a fixed wrap; and an orbiting scroll having an orbiting wrap to form a compression chamber by being engaged with the fixed wrap, having a rotational shaft coupling portion for coupling to couple the rotational shaft in a penetrating manner, and having one or more oil dimples provided at a peripheral end surface positioned between an inner circumferential portion and an outer circumferential portion of the rotational shaft coupling portion, wherein the one or more oil dimples is formed at a region among the peripheral end surface of the rotational shaft coupling portion, the region at which an interval between the inner circumferential portion and the outer circumferential portion of the rotational shaft coupling portion is larger than an orbiting radius of the orbiting scroll, and wherein the one or more oil dimples is formed so as to be recessed from an inner peripheral portion of the rotational shaft coupling portion toward the peripheral end surface of the rotational shaft coupling portion.

2. The scroll compressor of claim 1, wherein the one or more oil dimples communicates with the inner circumferential portion of the rotational shaft coupling portion.

3. The scroll compressor of claim 1, wherein the one or more oil dimples comprises a plurality of oil dimples, and an interval between the plurality of oil dimples is equal to or smaller than an orbiting radius.

4. The scroll compressor of claim 3, wherein at least one of the plurality of oil dimples communicates with the inner circumferential portion of the rotational shaft coupling portion, and another of the plurality of oil dimples is spaced from the outer circumferential portion of the rotational shaft coupling portion.

5. The scroll compressor of claim 4, wherein at least one outlet that communicates with the compression chamber and through which a refrigerant compressed at the compression chamber is discharged, is provided at the fixed scroll, and wherein an interval between the oil dimple that communicates with the inner circumferential portion of the rotational shaft coupling portion and the outlet is equal to or larger than an orbiting radius of the orbiting scroll.

6. The scroll compressor of claim 1, wherein an eccentric portion inserted into the inner circumferential portion of the rotational shaft coupling portion is formed at the rotational shaft, and wherein an oil supply groove is formed at one a side surface of the eccentric portion in an axial direction so as to communicate with an outer circumferential surface of the eccentric portion, the side surface contacting a plate surface of the fixed scroll.

7. The scroll compressor of claim 6, wherein a shaft accommodating hole to support the rotational shaft in a penetrating manner is formed at the fixed scroll, and wherein an oil supply passage is formed in the rotational shaft, and an oil supply hole to guide oil to a space between the oil supply passage and the shaft accommodating hole of the fixed scroll is formed at an intermediate portion of the oil supply passage.

8. A scroll compressor, comprising:

a fixed scroll having a fixed plate surface, a fixed wrap that protrudes from the fixed plate surface, and one or more outlets formed near an inner end of the fixed wrap; and an orbiting scroll having an orbiting plate surface provided with a rotational shaft coupling portion to eccentrically-couple a rotational shaft in an insertion manner, and having an orbiting wrap that protrudes from the orbiting plate surface and engaged with the fixed wrap, the orbiting wrap which forms a compression chamber including a suction chamber, an intermediate pressure chamber, and a discharge chamber, together with the fixed plate surface, the fixed wrap, and the orbiting plate surface, while performing an orbiting motion with respect to the fixed wrap, wherein one or more oil dimples is formed at a region of an end surface of the fixed wrap or the orbiting wrap, the region at which a wrap thickness is greater than an orbiting radius of the orbiting scroll, wherein the rotational shaft coupling portion is formed to penetrate an inner end of the orbiting wrap, and wherein the one or more oil dimples is formed at a wrap end surface positioned between an inner circumferential portion and an outer circumferential portion of the rotational shaft coupling portion, so as to communicate with the inner circumferential portion of the rotational shaft coupling portion.

9. The scroll compressor of claim 8, wherein the one or more oil dimples that communicates with the inner circumferential portion of the rotational shaft coupling portion is spaced from the outlet by an interval larger than an orbiting radius.

10. The scroll compressor of claim 9, wherein the one or more oil dimples comprises a plurality of oil dimples, and wherein an interval between the plurality of oil dimples is equal to or smaller than the orbiting radius.

11. The scroll compressor of claim 10, wherein at least one of the plurality of oil dimples communicates with the inner circumferential portion of the rotational shaft coupling portion, and another of the plurality of oil dimples is spaced from an outer circumferential surface of the rotational shaft coupling portion by an interval smaller than the orbiting radius.

12. The scroll compressor of claim 11, wherein an the one or more oil dimples is formed at an end surface positioned between the inner circumferential portion and the outer circumferential portion of the rotational shaft coupling portion.

13. A scroll compressor, comprising a casing configured to contain oil at a lower portion thereof;

a drive motor provided at an inner space of the casing;

a rotational shaft coupled to the drive motor, and having an oil supply passage in order to guide the oil contained in the casing to an upper side;

a frame provided below the drive motor, and having a first shaft accommodating hole to couple the rotational shaft in a penetrating manner;

a fixed scroll provided below the frame, having a second shaft accommodating hole to couple the rotational shaft in a penetrating manner, and having a fixed wrap; and an orbiting scroll provided between the frame and the fixed scroll, having a rotational shaft coupling portion to couple the rotational shaft thereto, and having an orbiting wrap to form a compression chamber by being engaged with the fixed wrap, wherein one or more oil dimples that communicates with the second shaft accommodating hole is formed at the fixed scroll corresponding to an end surface of the rotational shaft coupling portion, wherein one or more outlets through which a compressed refrigerant is discharged is provided at the fixed scroll, wherein the one or more oil dimples is spaced from the one or more outlets, and wherein the one or more oil dimples is formed so as to be recessed from an inner peripheral portion of the second shaft accommodating hole toward a peripheral end surface of the fixed scroll corresponding to an end surface of the rotational shaft coupling portion.

14. The scroll compressor of claim 13, wherein the one or more oil dimples is formed at an end surface of the rotational shaft coupling portion between an inner circumferential portion and an outer circumferential portion, and wherein the one or more oil dimples communicates with the inner circumferential portion of the rotational shaft coupling portion.

15. A scroll compressor, comprising:

a casing configured to contain oil at a lower portion thereof;

a drive motor provided at an inner space of the casing;

a rotational shaft coupled to a rotor of the drive motor, and having an oil supply passage in order to guide the oil contained in the casing to an upper side;

a fixed scroll provided below the drive motor, and having a fixed wrap; and an orbiting scroll having an orbiting wrap to form a compression chamber by being engaged with the fixed wrap, a rotational shaft coupling portion to couple the rotational shaft in a penetrating manner, and a plurality of oil dimples provided at a peripheral end surface positioned between an inner circumferential portion and an outer circumferential portion of the rotational shaft coupling portion, wherein at least one of the plurality of oil dimples communicates with the inner circumferential portion of the rotational shaft coupling portion, and another of the plurality of oil dimples is spaced from the outer circumferential portion of the rotational shaft coupling portion, and wherein an interval between the plurality of oil dimples is equal to or smaller than the orbiting radius.

16. The scroll compressor of claim 15, wherein the plurality of oil dimples is formed at a region among the peripheral end surface of the rotational shaft coupling portion, the region at which an interval between the inner circumferential portion and the outer circumferential portion of the rotational shaft coupling portion is larger than an orbiting radius of the orbiting scroll.

* * * * *